United States Patent [19]

Bryan, Jr.

[11] Patent Number: 5,056,244

[45] Date of Patent: Oct. 15, 1991

[54] DIGGING CHAIN VIBRATORY SYSTEM

[76] Inventor: John F. Bryan, Jr., 3510 Woodcreek Cir., Parker, Tex. 75002

[21] Appl. No.: 444,402

[22] Filed: Dec. 1, 1989

[51] Int. Cl.[5] ..... E02F 5/02

[52] U.S. Cl. ..... 37/191 A; 37/86; 37/DIG. 18; 405/182; 74/61; 74/87

[58] Field of Search ..... 37/69, 83, 84, 85, 86, 37/191 R, 191 A, 192 R, 192 A, DIG. 18; 299/69; 405/182; 74/61, 87

[56] References Cited

U.S. PATENT DOCUMENTS

| | | | |
|---|---|---|---|
| 1,185,834 | 6/1916 | Scalzitti | 37/DIG. 18 |
| 2,949,871 | 8/1960 | Finn | 405/182 X |
| 3,935,712 | 2/1976 | Erickson et al. | 405/182 |
| 4,038,763 | 8/1977 | Hutchinson | 37/80 R |
| 4,079,593 | 3/1978 | Flippin | 405/182 |
| 4,087,982 | 5/1978 | Golobay | 405/182 |
| 4,444,434 | 4/1984 | Gurries | 299/14 |
| 4,467,539 | 4/1984 | Gurries | 37/118 R |
| 4,553,443 | 11/1985 | Rossfelder et al. | 74/87 X |
| 4,570,616 | 2/1986 | Kunz et al. | 74/61 X |

FOREIGN PATENT DOCUMENTS

| | | | |
|---|---|---|---|
| 458640 | 3/1975 | U.S.S.R. | 37/DIG. 18 |
| 522310 | 9/1976 | U.S.S.R. | 37/DIG. 18 |
| 618490 | 6/1978 | U.S.S.R. | 37/DIG. 18 |
| 1362785 | 12/1987 | U.S.S.R. | 405/182 |

*Primary Examiner*—Dennis L. Taylor
*Assistant Examiner*—Arlen L. Olsen
*Attorney, Agent, or Firm*—John F. Bryan, Jr.

[57] ABSTRACT

The digging chain support boom of a continuous chain type excavating machine is vibrated in a directional mode so as to enhance digging efficiency. Directionally compliant mounting of the boom isolates this vibration from the machine proper while allowing unimpaired application of digging torque and crowd forces.

14 Claims, 7 Drawing Sheets

DIGGING CHAIN VIBRATORY SYSTEM

TECHNICAL FIELD

This invention relates to continuous digging chain or chain saw type excavating machines which use formation penetrating bit attachments, wherein vibration of said bit attachments is known to enhance productivity, and more particularly, to method and apparatus for vibrating the entire chain saw boom assembly in an angular mode about the suspension point thereof. The exciting force is applied at the center of percussion of the chain saw boom assembly which is suspended on directionally compliant mounts so as to support the chain saw while isolating the main frame from this vibration.

BACKGROUND AND SUMMARY OF THE INVENTION

A category of machines utilizing a continuous chain digging element is widely used in the earthmoving arts. These so-called chain saw excavating machines range from about ten horsepower to several hundred horsepower and are generally used in trenching applications for laying pipe or cable. These machines, examples of which are manufactured by TESMEC USA, Inc., of Mansfield, Tex., and Vermeer Manufacturing Company of Pella, Iowa, are mounted on crawler track undercarriages for purposes of both stability and flotation, however pneumatic tires may also be used.

These machines are generally more productive when working in the softer formations. Excavation of the harder formations is more difficult and costly in terms of time, power consumption and attrition. Very hard, specialized cutting teeth, such as Part Number CCT-735-HBR, made by the Carboloy Construction Products of Bristol, Virginia, have been developed which improve productivity in these hard materials, within limits.

To those skilled in the art, it is known that tooth vibration offers great potential for increased productivity as well as the capability of working in harder materials. Various studies that compare the efficacy of digging teeth, with and without vibration, have shown that dramatic production increases can be achieved with a vibratory system. Efforts to devise practical means for realizing such benefits with a vibrating chain saw have been thwarted by unacceptably rapid chain wear and the deleterious effects of the vibration to the supporting structure.

An object of the present invention is then, to provide a practical means for vibrating the cutting teeth while minimizing the factors which induce chain wear.

Isolation of this vibration so that it is confined to the chain saw boom assembly is essential to any practical design. Without such isolation, the vibratory forces are as destructive to the machine itself as to the formation it is excavating. A second object of the present invention is therefor, to provide suitable vibration isolating support means for the vibrating chain saw boom assembly. This support means must not only carry the high crowd and chain pull forces involved in the penetration of hard formations, but must also yield and allow the displacements of vibration so as to isolate the excavator main frame from the effects thereof.

Because of the shock and vibration forces attendant to cutting rock, normal operating conditions are such that chain saw excavators, without the invention, require an unusual degree of maintenance. Another object of the invention therefore, is to moderate these forces and reduce their effects on the excavator main frame and other components.

DETAILED DESCRIPTION

Figure 1:
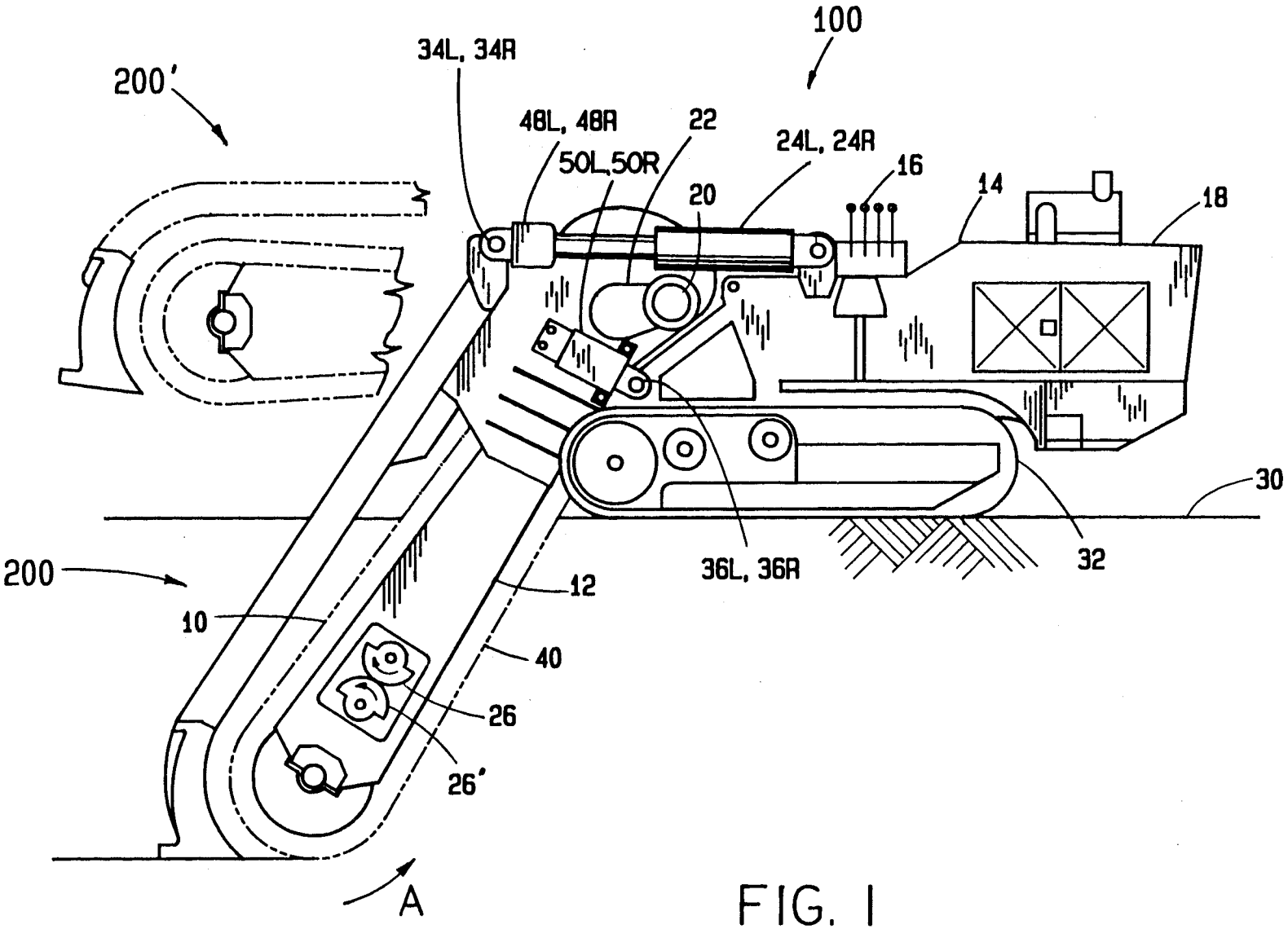
FIG. 1 shows a side view of the invention as applied to a typical excavator.
Figure 3:
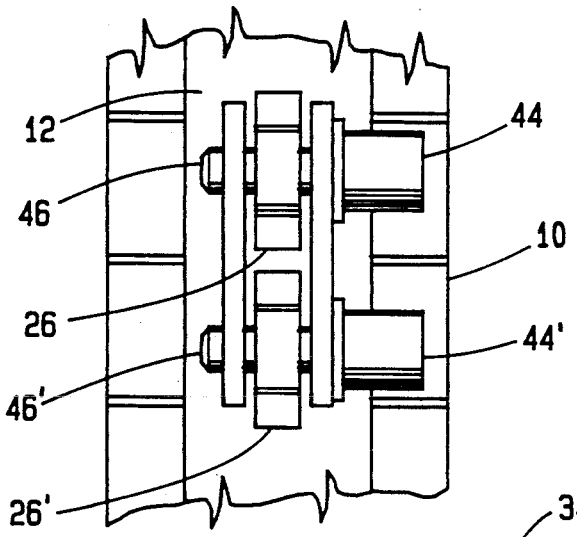
FIG. 3, shows a section view taken along the line 3—3 of FIG. 2.

Referring first to FIG. 1, herein is shown a typical chain saw type excavating machine 100 using a preferred embodiment of the present invention. The chain saw boom assembly 200 comprises a digging chain 10 mounted on a digging chain support boom 12 which is pivotally attached to excavator main frame 14. The chain saw boom assembly 200' shows the raised, non-working position of chain saw boom assembly 200. The operator controls 16 and the power supply 18 are mounted on the excavator main frame 14, while digging chain drive motors 20 and gear boxes 22 are mounted on either side of digging chain support boom 12. The working depth of the digging chain 10 is controlled by varying the length of hydraulic cylinders 24L and 24R. The excavator main frame 14 is supported for movement along the ground surface 30 by undercarriage 32 so that the digging chain 10 is crowded forward against the cutting surface 40. The digging chain 10 rotates in the direction of Arrow A so that material is broken from the cutting surface 40 and carried up to the ground surface 30.

In the preferred embodiment of the invention, balanced, counterroating eccentric weights 26 and 26' are mounted to the digging chain support boom 12, acting at the center of boom assembly 200 relative to pivotal connections 36L and 36R. The balanced eccentric weights 26 and 26' rotate on parallel horizontal axes substantially equidistant from, and parallel to the plane of cutting surface 40. The rotation is synchronized, and the phase angles are timed so that opposed centrifugal forces of rotation cancel out, producing a straight line vibration on an axis substantially perpendicular to the plane of cutting surface 40.

The balanced eccentric weights 26 and 26' are driven to rotate by two similar hydraulic motors 44 and 44', which are mutually connected to a hydraulic supply circuit. It has been found that rotating eccentric weights so driven will seek synchronous speeds and phase angles when fixedly mounted to a pivotal chain saw boom assembly. An alternate means for driving the counter-rotation of balanced eccentric weights 26 and 26' is by using only hydraulic motor 44, and driving shaft end 46' from shaft end 46 with a one-to-one ratio gear set.

Locating the balanced rotating eccentric weights 26 and 26' at or near to the center of percussion 42 of chain saw boom assembly 200 causes the entire chain saw boom assembly 200 to vibrate in an angular mode about connections 36L and 36R while minimizing the resulting reaction forces. The hydraulic cylinders 24L and 24R terminate in cylinder isolation connectors 48L and 48R to make pivotal connections to the excavator main frame 14 at 38L and 38R. The digging chain support boom 12 is joined to the pivotal connections 36L and 36R by excavator main frame isolation connectors 50L and 50R which assume a nominal deflection under the basic crowd and chain load working conditions. The hydraulic cylinders 24L and 24R in assembly with isolation connectors 48L and 48R are "two point members", and thus, are subjected only to axial loading. These components also deflect under crowd forces, both by compression of the hydraulic fluid in cylinders 24L and 24R and by deformation of isolation connectors 48L and 48R. This deflection is beneficial in that it protects the main frame 14 from fatigue stresses and damage by shock overloads. Isolation connectors 48L and 48R can relieve hydraulic cylinders 24L and 24R of the burden of this function through appropriate sizing. The excavator main frame isolation connectors 50L and 50R are placed perpendicular to, and in line with, the plane of cutting surface 40, thus the crowd and vibration forces are carried axially by isolation connectors 50L and 50R while chain pull forces are carried perpendicular to the axis thereof.

Figure 6:
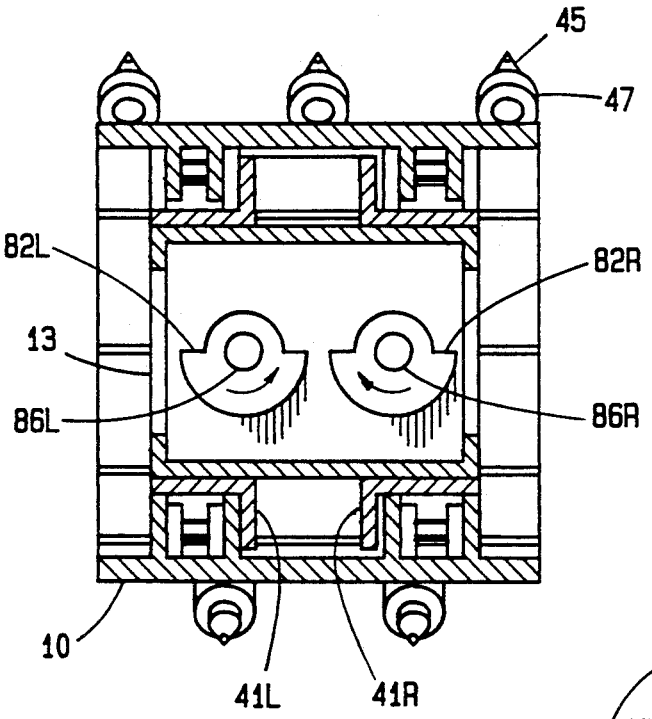
FIG. 6 shows a section view taken along line 6—6 in FIG. 5.
Figure 5:
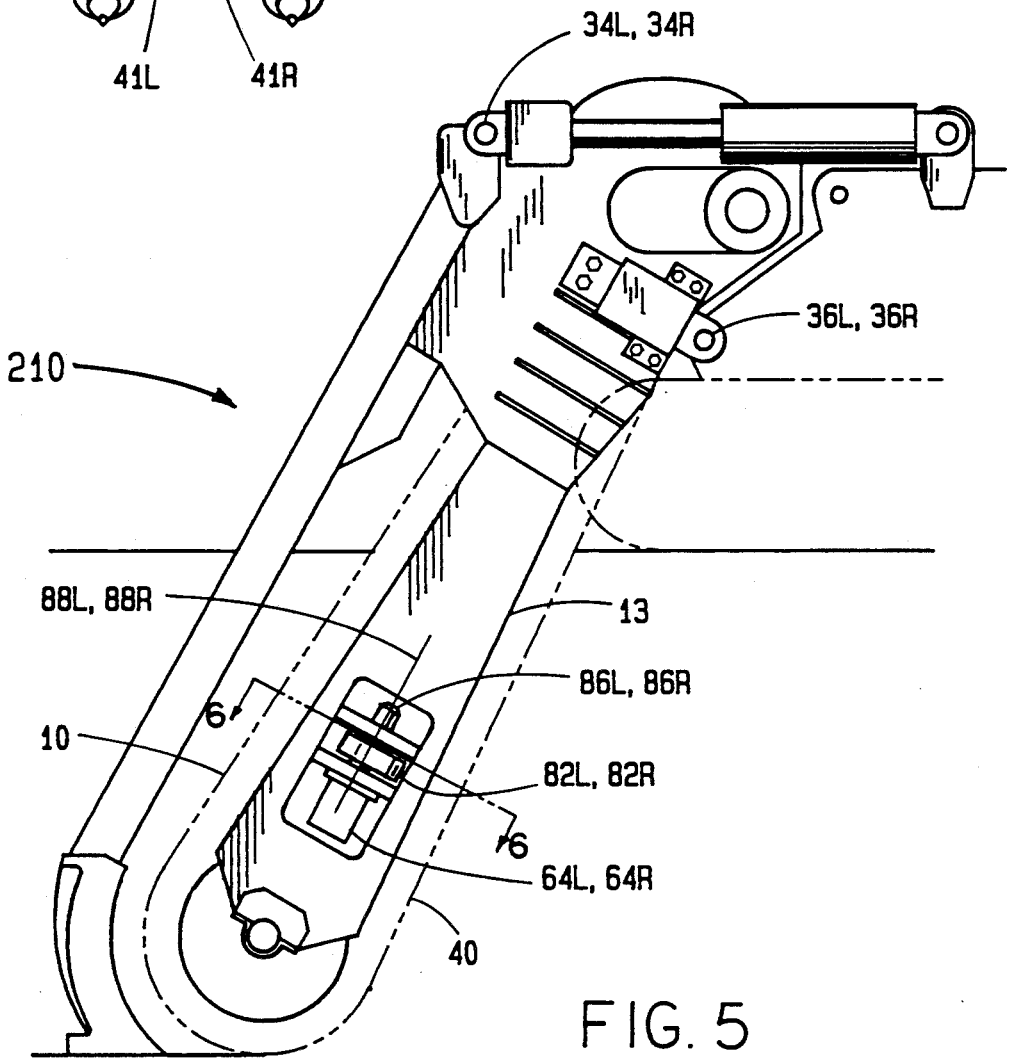
FIG. 5 shows a detailed side view of a second preferred embodiment of the invention.

An alternate embodiment of the invention is mounted in the digging chain support boom 13 of chain saw boom assembly 210, as shown in FIGS. 5 and 6, where balanced eccentric weights 82L and 82R are shown to be counter-rotating on parallel axes 88L and 88R which lie substantially equidistant from, and parallel to the plane of cutting surface 40 and extend in a vertical direction toward the main frame pivotal connections 36L and 36R. The rotation of eccentric weights 82L and 82R is synchronized, and the phase angles are timed so that opposed centrifugal forces of rotation cancel out, producing a straight line vibration perpendicular to the plane of cutting surface 40.

The balanced eccentric weights 82L and 82R are driven to rotate by two similar hydraulic motors 64L and 64R, which are mutually connected to a hydraulic supply circuit. It has been found that rotating eccentric weights so driven will seek synchronous speeds and phase angles when fixedly mounted to a pivotal chain saw boom assembly. An alternate means for driving the counter-rotation of balanced eccentric weights 82L and 82R is by a single hydraulic motor 44, and driving shaft end 86L together with shaft end 86R using a one-to-one ratio gear set. In FIG. 6 are shown chain back supports 41L and 41R which serve to support the digging chain 10 for engagement with cutting surface 40.

Figure 7:
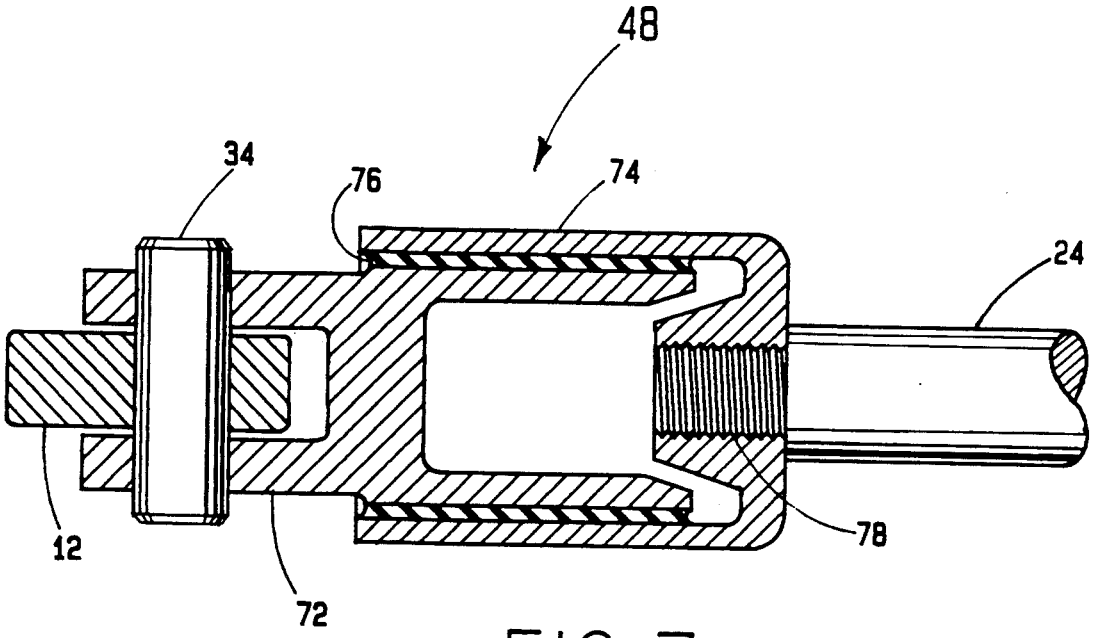
FIG. 7 shows a section view of a cylinder isolation mount taken along line 7—7 in FIG. 2.
Figure 8:
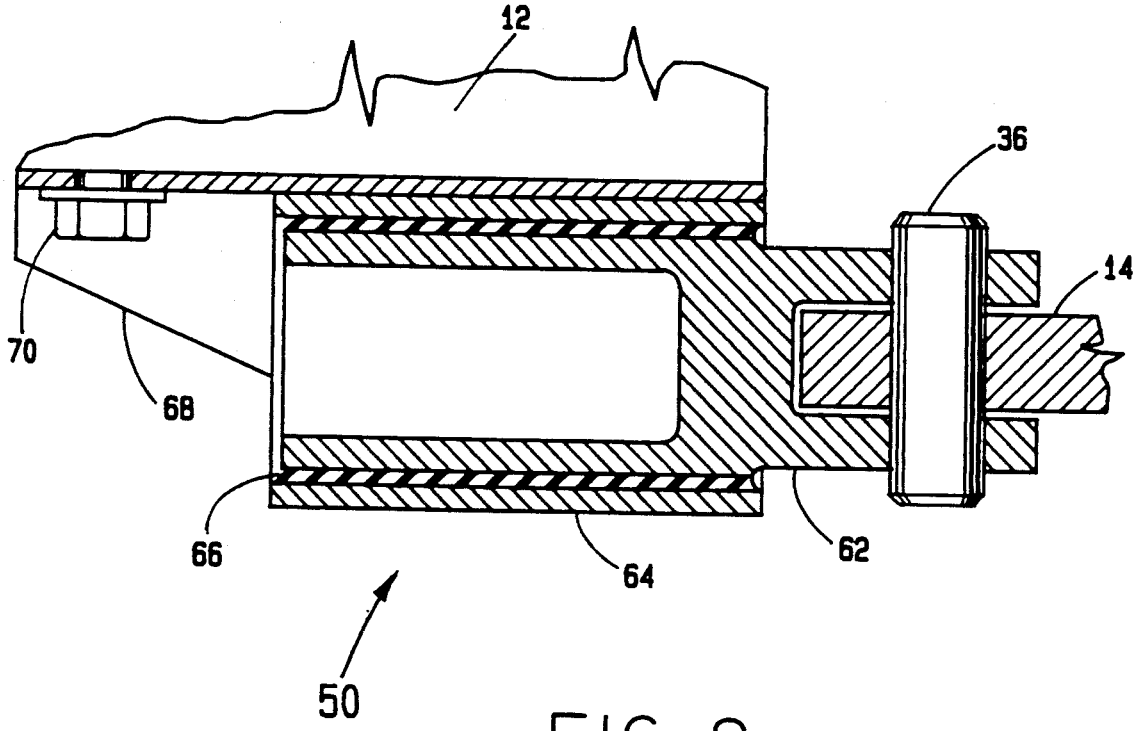
FIG. 8 shows a section view of the primary suspension element taken along line 8—8 in FIG. 2.
Figure 11:
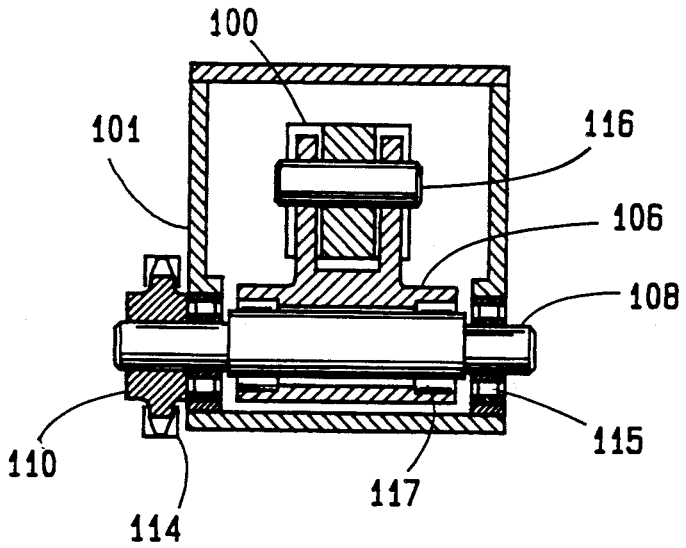
FIG. 11 shows a section view of the oscillatory means of FIG. 10 taken along line 11—11.

The isolation connectors 48 and 50 are shown in detail in FIGS. 7 and 8. The inner member 72 of cylinder isolation connector 48 is connected to digging chain support boom 12 by pivotal connection 34 while outer member 74 is connected to hydraulic cylinder 24 by threaded connection 78. The outer surface of inner member 72 is joined to the inner surface of outer member. 74 by a continuous resilient layer 76 of substantially uniform thickness. The forces transmitted by this cylinder isolation connector 48 are, as previously discussed, purely axial in nature and are thus carried by resilient layer 76 in shear. The material of choice for resilient layer 76 is an elastomer since such materials are inherently stiff in compression and soft in shear. This allows these axial forces to be cushioned by relatively generous deflections. The inner member 62 of excavator frame isolation connector 50 is connected to the excavator main frame 14 by pivotal connection 36 while the outer member 64 is welded to mount 68 which in turn is fixed to digging chain support boom 12 by bolts 70. The outer surface of inner member 62 is joined to the inner surface, of outer member 64 by a continuous resilient layer 66 of substantially uniform thickness, preferably made of the same elastomeric material as resilient layer 76. As a result of the previously discussed orientation, crowd and vibration forces are carried by resilient layer 66 in shear and chain pull forces are carried in compression. Consequently, crowd and vibration forces are cushioned while the chain pull forces are carried with very little deflection.

Normal operating conditions for chain saw excavators without the invention are generally considered abusive. Not only does the cutting of rock set up random vibration forces, but large chunks of rock are subject to breaking free and wedging between the chain 10 and the work face 40 causing heavy shock loads. The straight line vibration produced by counter-rotation of balanced eccentric weights 26 and 26' disrupts such wedging action. The vibration isolating connectors 48 and 50 also serve to moderate the random vibration forces, thus protecting the excavator main frame 14 and components mounted thereon. Surprisingly, the application becomes less abusive when accompanied by isolated vibration.

The cutting speed of digging chain 10 can be reduced when vibration is applied, while still improving production, because of the larger average chip size. Since cutting speed is an exponential factor contributing to the wear of digging chain 10, any speed reduction will be rewarded with longer service life. Straight line vibration perpendicular to the line of travel will not wear digging chain 10 as would multi-directional vibration and thus is the vibratory mode of choice.

Figure 2:
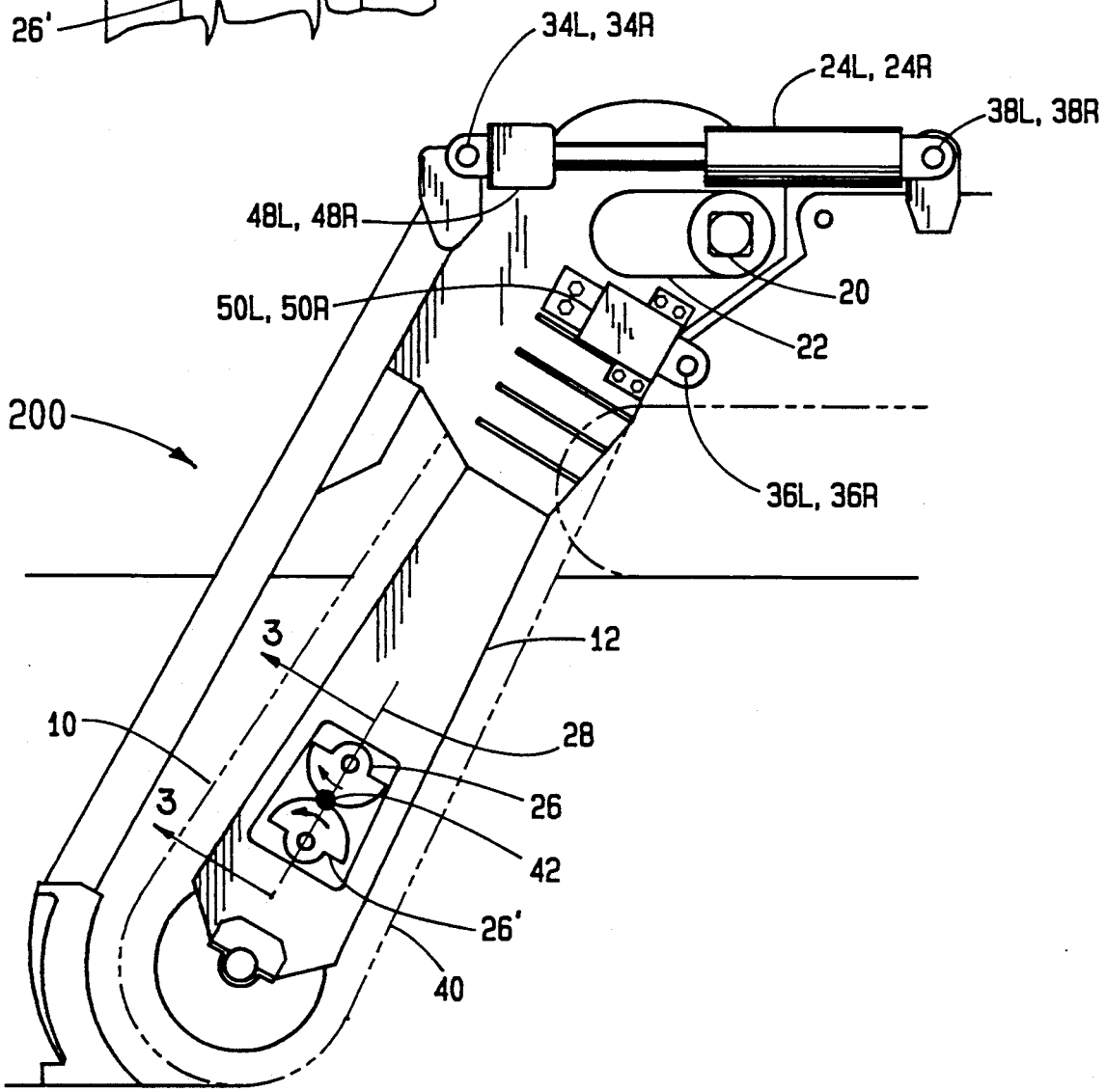
FIG. 2 shows a detailed side view of the preferred embodiment of the invention shown in FIG. 1.
Figure 4:
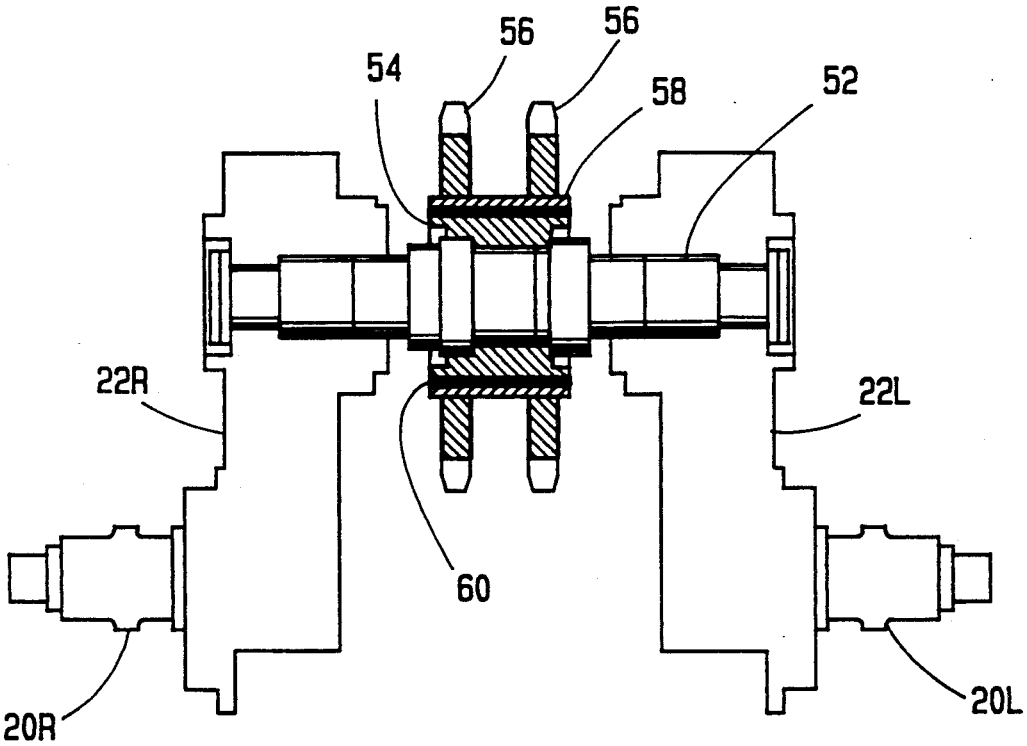
FIG. 4 shows a section view of the digging chain drive.

Referring now to FIG. 4, which is taken along section line 4—4 of FIG. 2, there is shown a detailed cross-section of the drive means for digging chain 10. Hydraulic motors 20R and 20L drive through gear reducers 22R and 22L to rotate the drive shaft 52 which powers the rotation of the digging chain drive sprockets 56.

The sprocket outer hub 58 is joined to the sprocket inner hub 54 by resilient coupling 60. In this embodiment, the diameter and length of coupling 60 determine the level of shear stress in the elastomeric material of coupling 60 as it carries the torque required to drive digging chain 10. The angular deflection of sprocket outer hub 58 relative to sprocket inner hub 54 is determined by the radial thickness of resilient coupling 60. As the radial section thickness of resilient coupling 60 is reduced, said angular deflection decreases in a direct relationship. When working, the average pull of digging chain 10 establishes a basic dynamic angular deflection of resilient coupling 60 which varies with transient load variations induced by either the straight line vibration or by random shock conditions. A coupling at the input end of drive shaft 52 could also be designed to achieve the same working characteristics.

If a digging chain 10 cutting speed of 300 feet/minute and a vibration frequency of 2,400 cycles/minute are assumed, it can be readily shown that each tooth 45 impacts the work face 40 every 1.5" of digging chain 10 travel. The amplitude of vibration of the chain saw 200 is determined by its total mass-moment as related to the exciting straight line vibratory force and frequency. It is clear that the greater the amplitude of the chain saw 200, the larger the chip cut from the work face 40, but the more important factor is the peak cutting force per tooth 45 as calculated by the sum of the crowd force applied by undercarriage 30, plus the straight line vibratory force, divided by the number of teeth 45 engaged with cutting surface 40. The average tooth force required varies with the hardness of the formation, ranging from 800 lbs. to 4,000 lbs. for materials that are considered economically workable.

Figure 9:
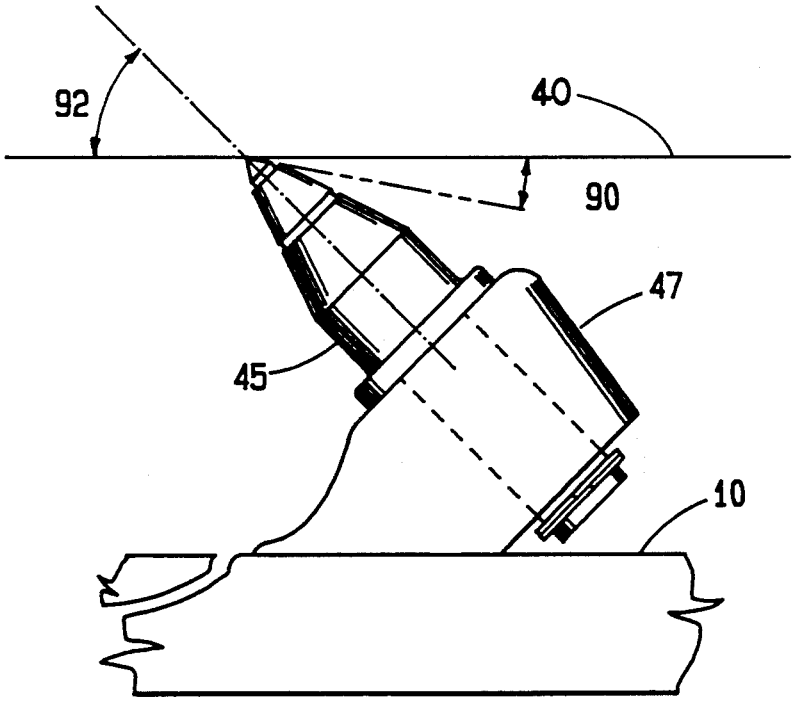
FIG. 9 shows a detailed view of a cutting tooth in contact with the work face.

FIG. 9 shows the relationship between the tooth angle 92 and the cutting clearance angle 90, and it can be seen that the effective clearance angle 90 can be increased, within limits, by increasing the tooth angle 92.

It is clear that resistance to the travel of digging chain 10 will increase as the teeth 45 are forced more intimately into cutting surface 40 by the aforementioned straight line vibratory forces, and that this increased resistance will proportionately increase the angular deflection of the sprocket outer hub 58 relative to the sprocket inner hub 54. This increment should be no more than about 20% of the travel/vibration cycle of tooth 45 in order to avoid over running the tooth cutting clearance angle 90. This will occur when the instantaneous tooth penetration rate divided by the cutting speed exceeds the tangent of the cutting clearance angle 90.

This clearance consideration thereby establishes the radial thickness of resilient coupling 60. The mass of sprocket outer hub 58 is then elected, by varying the outside diameter thereof, to place the natural frequency of the resilient coupling 60 well out of the range of any exciting frequency.

Figure 10:
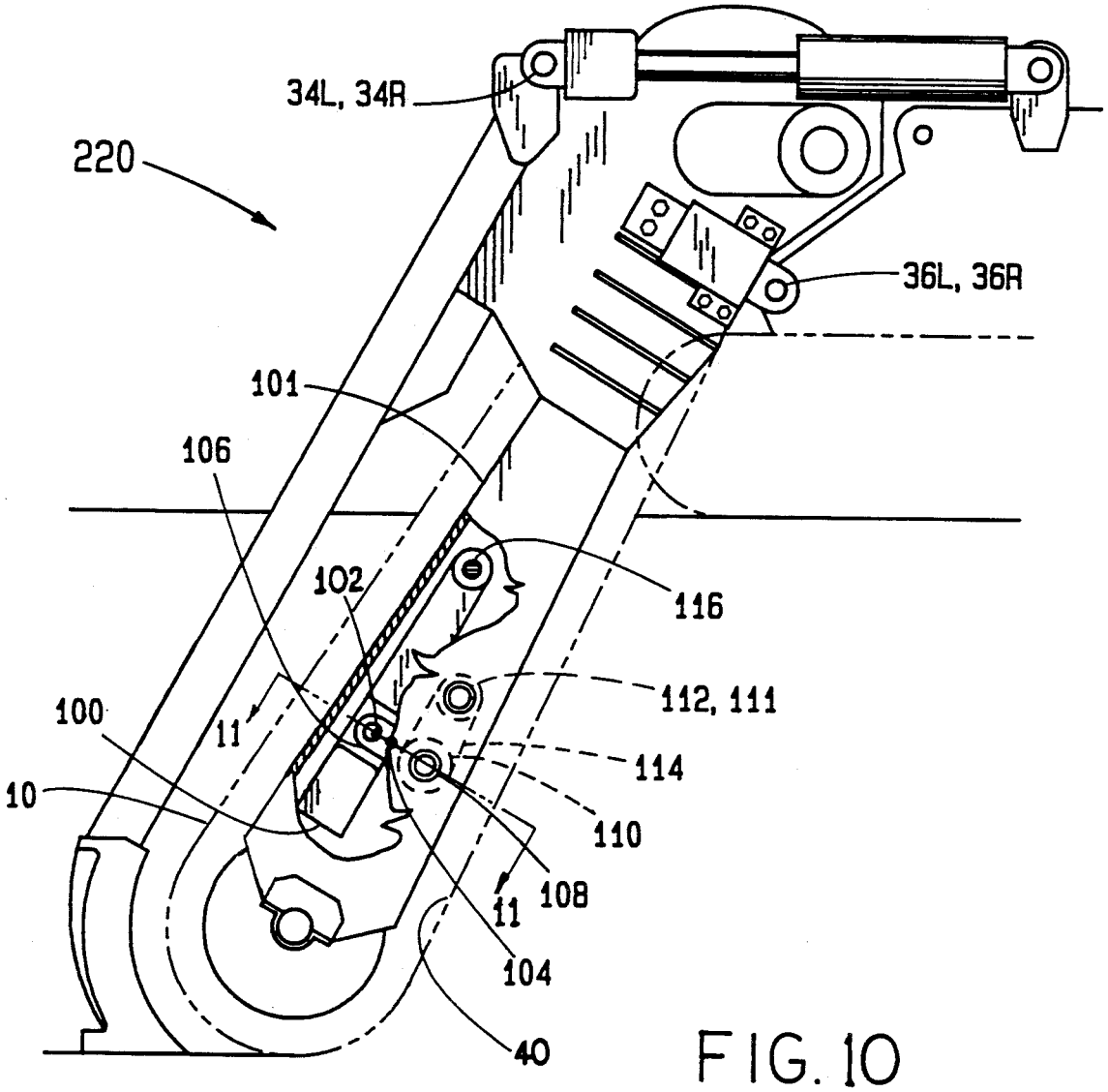
FIG. 10 shows a detailed side view of an oscillatory means for chain boom assembly vibration.

Other alternate means of exciting directionally oriented vibration are available within the scope of the invention. The chain saw boom assembly 220 of FIG. 10 comprises a weight 100 which is caused to oscillate about its pivotal attachment 116 to digging chain support boom 101. The oscillating vibratory movement of weight 100 is driven by motor means 111, not shown, which rotates drive sprocket 112 and, by means of chain 114, driven sprocket 110. Driven sprocket 110 is mounted on eccentric shaft 108, rotating in bearings 115. Link 106 is mounted on the eccentric portion of eccentric shaft 108 by needle bearings 117 and connected to weight 100 by pin 116 so that the rotation of said eccentric shaft 108 causes oscillatory movement of weight 100 at a desired frequency. Vibratory reaction forces at the pivotal attachment 116 are minimized by locating the connection 116 of link 106 at the center of percussion 102 of weight 100. The path of oscillation of weight 100 is about an arc having a perpendicular bisector lying substantially parallel to the plane of cutting surface 40. The eccentric shaft 108 is located at the center of percussion 104 of chain boom assembly 220 so as to minimize the vibratory reaction forces at said resilient connections 36L and 36R.

Figure 12:
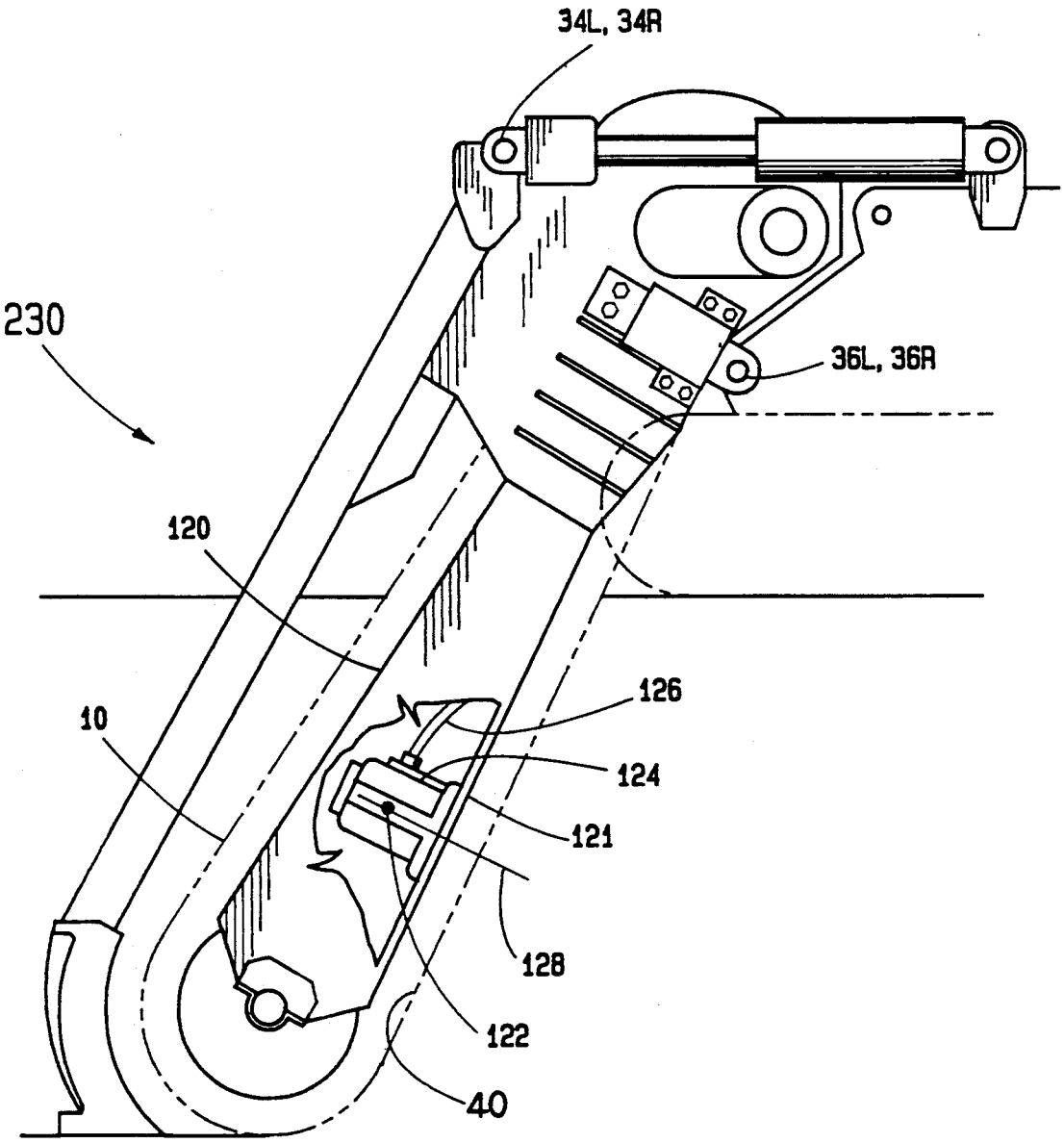
FIG. 12 shows a detailed side view of a reciprocating means for chain boom assembly vibration.

Another alternate means of exciting directionally oriented vibration available within the scope of the invention is shown in FIG. 12 wherein a commercially available reciprocating piston vibrator 124, such as a Model VMSAC 1500 air piston vibrator, made by Cleveland Vibrator Company of Cleveland, Ohio is mounted to back wall 121 of digging chain support boom 120 in chain saw boom assembly 230. Air is supplied to vibrator 124 through connecting hose 126 The location of vibrator 124 is at the center of percussion 122 of chain saw boom assembly 230, and the piston axis of reciprocation 128 is perpendicular to the plane of cutting surface 40.

It will be understood that the invention is not limited to the disclosed embodiments, but is capable of rearrangement, modification and substitution of parts and elements without departing from the spirit of the invention.

I claim:

1. A chain type excavating machine comprising:

a main frame;

an undercarriage supporting said main frame for forward and reverse movement along the ground;

an elongate digging chain support boom having upper and lower ends;

upper and lower chain sprockets rotatably mounted at said upper and lower boom ends respectively;

a continuous digging chain in assembly with said upper and lower chain sprockets for rotation about said digging chain support boom;

cutting means at the periphery of said continuous digging chain for cutting and excavating;

pivotal connecting means adjacent said boom assembly upper end connecting said digging chain support boom to said main frame for rotation thereof from a first raised position to a second lowered position in which said digging chain engages the ground along a cutting surface;

hydraulic cylinder means, connecting said main frame to said boom to a position adjacent said upper sprocket, for rotating said boom assembly about said pivotal connecting means between said first and second positions;

chain back support means between said upper and lower chain sprocket means for holding said cutting means against said cutting surface;

chain sprocket drive means for rotating said continuous digging chain about said digging chain support boom; and directionally oriented vibration exciting means acting at the center of percussion of said digging chain support boom assembly with respect to said pivotal connecting means for vibrating said boom assembly only in a direction perpendicular to said cutting surface.

2. A chain type excavating machine according to claim 1 wherein said directionally oriented vibration exciting means further comprises:

a plurality of balanced rotary eccentric weights rotating on parallel axes substantially parallel to and equidistant from said cutting surface; and drive means mounted on said digging chain support boom for synchronously phased counter-rotation of said rotary eccentric weights.

3. A chain type excavating machine according to claim 2 wherein said drive means further comprises;

individual motor means for independently driving the rotation of each said eccentric weight so that said rotating eccentric weights are allowed to seek synchronous speed and balancing phase angles.

4. A chain type excavating machine according to claim 2 wherein said drive means further comprises;

motor means for driving the rotation of at least one said eccentric weight; and geared connecting means for driving all said eccentric weights at synchronous speed and balancing phase angles.

5. A chain type excavating machine according to claim 1 wherein said directionally oriented vibration exciting means comprises:

a weight mounted for reciprocating movement on an axis lying perpendicular to said cutting surface; and drive means mounted on said digging chain support boom for reciprocating said weight.

6. A chain type excavating machine according to claim 1 wherein said directionally oriented vibration exciting means comprises:

a weight mounted for oscillating movement along an arc having a perpendicular bisector lying parallel to the plane of said cutting surface; and drive means mounted on said digging chain support boom for oscillating said weight.

7. A chain type excavating machine according to claim 1 wherein said pivotal connecting means further comprises;

directionally resilient means oriented so as to be resistant to displacement parallel to said cutting surface and relatively compliant to displacement perpendicular thereto.

8. A chain type excavating machine according to claim 7 wherein said directionally resilient means further comprises;

an elongate inner member on each side of said boom lying axially perpendicular to the plane of said cutting surface;

a tubular outer member encompassing the longitudinal surfaces of said inner member so as to allow clearance therebetween;

a resilient elastomeric intermediate member of uniform thickness bonding said outer member to said inner member along the cooperating longitudinal surfaces thereof; and connecting means for attachment of said inner member and said outer member to said digging chain support boom and said main frame alternatively so that compliance is provided by the shearing deformation of said elastomer perpendicular to the plane of said cutting surface and stiffness is provided by the resistance of said elastomer to compression parallel thereto.

9. A chain type excavating machine comprising:

a main frame;

an undercarriage supporting said main frame for forward and reverse movement along the ground;

an elongate digging chain support boom having upper and lower ends;

upper and lower chain sprockets rotatably mounted at said upper and lower boom ends respectively;

a continuous digging chain in assembly with said upper and lower chain sprockets for rotation about said digging chain support boom;

cutting means at the periphery of said continuous digging chain for cutting and excavating;

a pivotal connection to said main frame proximate said boom assembly upper end for rotating said boom assembly from a first raised position to a second lowered position in which said digging chain engages the ground along a cutting surface, said continuous further comprising directionally resilient means for permitting load induced displacement perpendicular to said cutting surface and resisting such displacement parallel thereto, actuation means connecting said main frame to said boom at a position adjacent said upper sprocket for rotating said boom assembly about said pivotal connection between said first and second positions;

chain back support means between said upper and lower chain sprocket means for holding said cutting means against said cutting surface; and chain sprocket drive means for rotating said continuous digging chain about said digging chain support boom.

10. A chain type excavating machine according to claim 9 wherein said directionally resilient means further comprises;

an elongate inner member on each side of said boom lying axially perpendicular to the plane of said cutting surface;

a tubular outer member encompassing the longitudinal surfaces of said inner member so as to allow clearance therebetween;

a resilient elastomeric intermediate member of uniform thickness bonding said outer member to said inner member along the cooperating longitudinal surfaces thereof; and connection means for attachment of said inner member and said outer member to said digging chain support boom and said main frame alternatively so that compliance is provided by the shearing deformation of said elastomer perpendicular to the plane of said cutting surface and stiffness is provided by resistance of said elastomer to compression parallel thereto.

11. A chain type excavating machine comprising:

a main frame;

an undercarriage supporting said main frame for forward and reverse movement along the ground;

an elongate digging chain support boom having upper and lower ends;

upper and lower chain sprockets rotatably mounted at said upper and lower boom ends respectively;

a continuous digging chain in assembly with said upper and lower chain sprockets for rotation about said digging chain support boom;

chain sprocket drive means for rotating said continuous digging chain about said digging chain support boom;

cutting means at the periphery of said continuous digging chain for cutting and excavating;

a pivotal connection to said main frame proximate said boom assembly upper end for rotating said boom assembly from a first raised position to a second lowered position in which said digging chain engages the ground along a cutting surface;

at least one hydraulic cylinder having first and second ends connected to said main frame and said digging chain boom alternatively for rotating said boom assembly about said pivotal connection between said first and second positions;

an elongate inner member axially extending from said first end;

a tubular outer member axially encompassing the longitudinal surfaces of said inner member so as to allow clearance therebetween;

a resilient elastomeric intermediate member of uniform thickness bonding said outer member to said inner member along the cooperating longitudinal surfaces thereof so as to cushion dynamic axial loading of said hydraulic cylinder; and chain back support means between said upper and lower chain sprocket means for holding said cutting means against said cutting surface.

12. A chain type excavating machine comprising:

a main frame;

an undercarriage supporting said main frame for forward and reverse movement along the ground;

an elongate digging chain support boom having upper and lower ends;

upper and lower shafts rotatably mounted at said upper and lower boom ends respectively;

upper and lower chain sprockets mounted on said upper and lower shafts respectively;

a continuous digging chain in assembly with said upper and lower chain sprockets;

cutting means at the periphery of said continuous digging chain for cutting and excavating;

power means connected to said upper shaft for driving said upper shaft means so as to rotate said continuous digging chain about said digging chain boom;

pivotal connecting means adjacent said boom assembly upper end for connecting said boom to said main frame for rotation thereof from a first raised position to a second lowered position so that said digging chain engages the ground along a cutting surface;

hydraulic cylinder means, connecting said main frame to said boom at a position adjacent said upper sprocket, for rotating said boom assembly about said pivotal connecting means between said first and second positions;

chain back support means between said upper and lower sprocket means for holding said cutting means against said cutting surface; and resilient coupling means interposed between said power means and said upper sprocket means for isolating said power means from transient digging chain loads.

13. A chain type excavating machine according to claim 12 wherein said resilient coupling means further comprises;

an outer sprocket hub for mounting said upper sprocket;

an inner sprocket hub for mounting on said upper shaft wherein the outside diameter of said inner hub is less than the inside diameter of said outer hub; and a resilient intermediate member joining said inner and outer hubs so that compliance is provided for angular displacement of said outer sprocket hub relative to said inner sprocket hub without significant relative radial displacement thereof.

14. A chain type excavating machine according to claim 13 wherein said resilient intermediate member comprises an elastomeric material bonded to both said inner and outer sprocket hubs.

* * * * *